United States Patent [19]

Chandley

[11] Patent Number: 4,651,799

[45] Date of Patent: Mar. 24, 1987

[54] VENTED CASTING MOLDS AND PROCESS OF MAKING THE SAME

[75] Inventor: George D. Chandley, Amherst, N.H.

[73] Assignee: Hitchiner Manufacturing Co., Inc., Milford, N.H.

[21] Appl. No.: 824,154

[22] Filed: Jan. 30, 1986

[51] Int. Cl.[4] ..... B22C 7/02; B22C 9/04

[52] U.S. Cl. ..... 164/35; 164/34; 164/45; 164/246; 164/249; 164/361; 164/363; 164/410; 164/516

[58] Field of Search ..... 164/34, 35, 36, 45, 164/235, 245, 246, 249, 361, 363, 410, 516; 249/61, 62, 141

[56] References Cited

U.S. PATENT DOCUMENTS

| | | | |
|---|---|---|---|
| 2,474,186 | 6/1949 | Marks | 164/410 X |
| 3,863,706 | 2/1975 | Chandley et al. | 164/255 |
| 3,889,919 | 6/1975 | Ladney, Jr. | 249/141 |
| 3,900,064 | 8/1975 | Chandley et al. | 164/493 |
| 4,532,976 | 8/1985 | Chandley | 164/363 |

FOREIGN PATENT DOCUMENTS

| | | | |
|---|---|---|---|
| 42-4126 | 2/1967 | Japan | 164/410 |
| 2126148A | 3/1984 | United Kingdom | 164/36 |

*Primary Examiner*—Nicholas P. Godici

*Assistant Examiner*—J. Reed Batten, Jr.

*Attorney, Agent, or Firm*—Edgar H. Kent

[57] ABSTRACT

The mold body contains a cavity and at least one vent passage for venting gas from the cavity through the body. The vent passage has a portion of predetermined regular shape extending part-way through the cavity wall defining at one end an inlet portion opening into a portion of the cavity with a substantially greater resistance than the cavity to penetration therein of casting material. The vent passage further has an outlet portion formed by an irregular crack in the mold body extending from an inner end exposed to the inlet portion through the mold body, the crack having one of its transverse cross-section dimensions short enough to prevent leakage of casting material therethrough. The mold is made by forming a partially bonded ceramic material containing a casting cavity and incorporating in a wall of the cavity a vent pattern of a shape to mold the portion of predetermined regular shape of the vent passage. The mold is heated to a temperature below the melting point temperature of the pattern for a time sufficient so that heat expansion of the pattern causes the crack part of the vent passage to form. The mold is then heated to higher temperatures to cause the vent pattern to volatilize and escape from the mold body.

12 Claims, 12 Drawing Figures

FIG 1
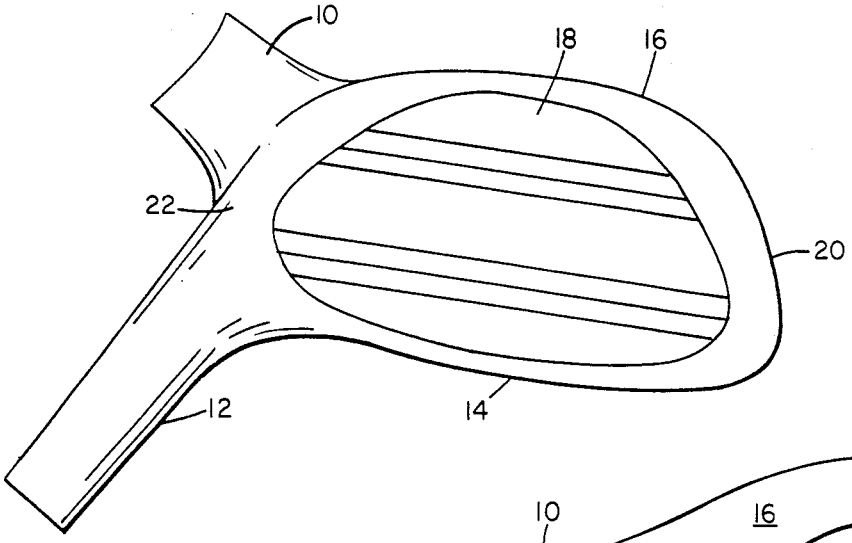
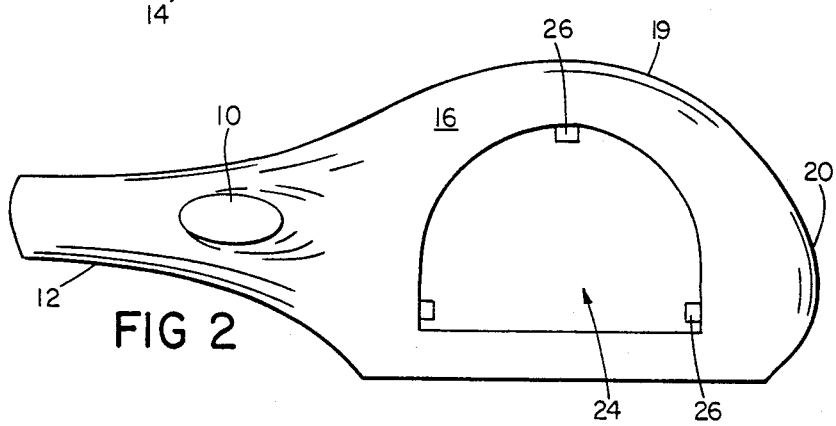
FIG 2
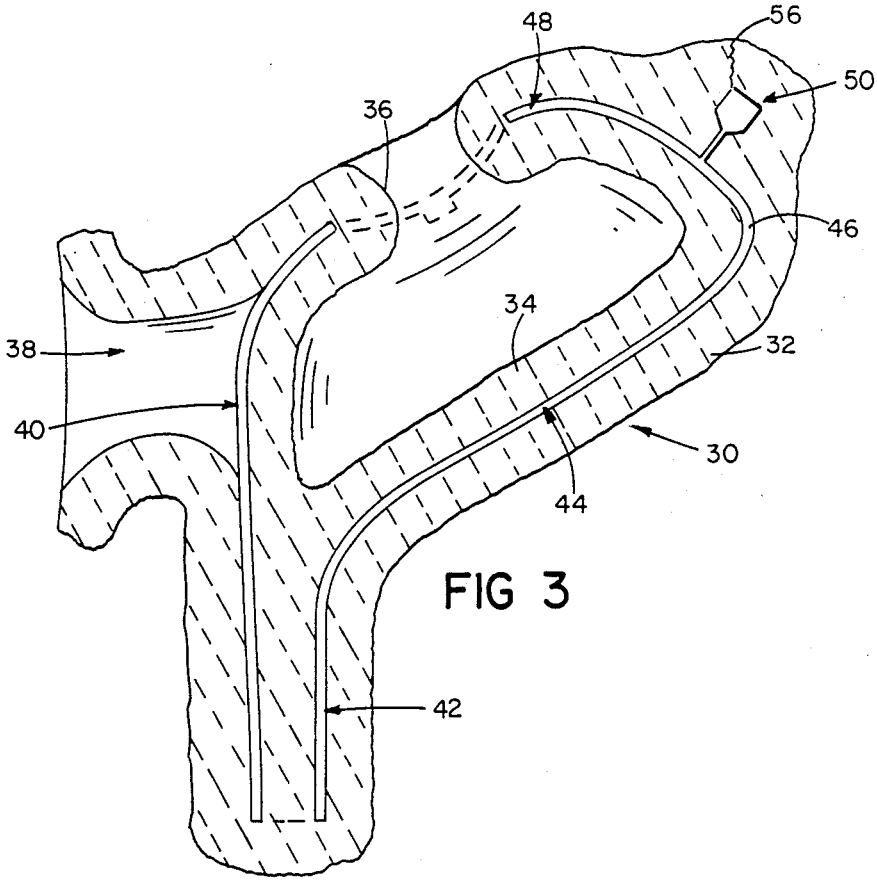
FIG 3

VENTED CASTING MOLDS AND PROCESS OF MAKING THE SAME

BACKGROUND OF THE INVENTION

1. Field of the Invention

This invention relates to vented casting molds and to processes of making the same, particularly such molds useful for casting in an evacuated atmosphere by a process such as disclosed in U.S. Pat. Nos. 3,863,706 and 3,900,064, especially when very thin walled portions are to be cast.

2. Description of the Related Art

The casting cavities of investment molds need permeability for the escape of gases present in those cavities to insure complete fill-out of the cavities during filling. This is also true when the mold is being used in the counter-gravity, applied vacuum filling process disclosed in the aforesaid patents. For making such molds, a ceramic composition can be used which in its final hardened state has a permeability of the order of 14 cc nitrogen per square inch (6.5 $cm^2$) of mold area per minute at a nitrogen pressure of 0.5 p.s.i. This provides adequate venting to insure filling of cavities of which the shortest transverse cross-section dimension is about 0.04 inch (1.0 mm) or more and for gas removal during casting as long as the area of this cross-section is less than a few square inches. However, it has been difficult or impossible to achieve complete fill-out of very thin portions having one transverse cross-section dimension less than 0.04 inches, especially those of greater area than three square inches (19.5 $cm^2$).

Attempts to solve this problem by a mold-making composition which will provide molds of greater permeability have not proven satisfactory. The molds formed therewith have been weaker, prone to failure in casting, and the mold cavity surfaces are too porous, resulting in rough cast surfaces. Vent slots ground in, or molded through, the mold have a smallest transverse cross-section dimension so large that the material being cast leaks out unacceptably, and such grinding or molding are difficult and expensive. Molding thinner slots about a pattern in the "lost wax" process of forming the casting cavity is not feasible, because the extremely thin lost wax pattern for the slit would be too fragile to withstand embedding in the mold-forming composition and the outer end of the pattern would be embedded in that composition, plugging the slots.

BRIEF SUMMARY OF THE INVENTION

This invention provides vented casting molds with a novel vent structure which greatly increases the permeability of the mold cavity adjacent the vent inlet, without permitting leakage of the material being cast during filling and casting, or weakening the mold to endanger its integrity throughout the casting operation. The invention further provides a novel method of making such a mold which is not difficult or costly to perform.

Vented casting molds according to the invention have a body of hard, coherent refractory material which contains a cavity for casting a desired shape, and at least one vent passage suitable for venting gas from the interior of a portion of the cavity through the wall of the mold body. This passage has an inlet portion of predetermined regular shape defining at one end an opening into a portion of the cavity and having one of its transverse cross-section dimensions adjacent to the opening so short that the inlet portion of the vent passage has a substantially greater resistance to penetration by casting material than does the casting cavity portion into which the inlet portion of the vent passage opens. The vent passage has an outlet portion formed by an irregular crack in the mold body, which extends from an inner end exposed to the inlet portion of the vent passage through the outer surface of the mold body and has one of its transverse cross-section dimensions sufficiently short to prevent leakage through the crack of casting material able to penetrate the inlet portion of the vent passage.

In preferred structures, the specified transverse cross-section dimension of the crack is shorter than that of the inlet portion, desirably less than 0.015 inches (0.38 mm) and about 0.02 inches (0.51 mm), respectively, and the other transverse cross-section dimension of the crack is longer than, and substantially parallel to, the other transverse cross-section dimension of the inlet portion.

The method of the invention forms the mold body of a refractory material which, in its initial state, is partially bonded and relatively weak and shapeable and which is ultimately converted to a fully bonded, hard coherent state, by heating to elevated temperature. The cavity of a shape to be cast is formed in the body and there is incorporated in a wall of the casting cavity at least one vent pattern having a shape to mold in the body a vent passage portion of a predetermined, regular shape, extending from an inlet opening in the cavity only part way through the cavity wall. The mold body is heated to a temperature below the melting point temperature of the pattern for a time sufficient so that heat expansion of the pattern causes the mold body to crack, forming the desired crack extending from adjacent the vent pattern through the exterior of the mold body to complete the vent passage. The mold body is further heated at a sufficiently higher temperature and for a time sufficient to cause the pattern to volatilize, burn and escape from the mold body, and to complete hardening of the mold body.

In the preferred practice of the method, the mold body is formed about a "lost wax" casting pattern to which the vent pattern or patterns have been attached at the vent inlet opening end. The casting pattern has a lower melting point temperature than the vent pattern(s), so that it melts while the mold body is being heated below the melting point temperature of the vent pattern to produce the vent crack, melted casting pattern is allowed to flow out of the mold prior to heating to higher temperature, and remaining melted casting pattern is volatilized out by the subsequent higher temperature heating. The material forming the vent pattern has substantially higher tensile strength than the material of the casting pattern, such as that of suitable materials, nylon or polystyrene, which have a heat expansion coefficient of about $9\times10^{-5}$ in/in/°F. The end of the vent pattern opposite that which forms the inlet opening is enlarged and is shaped to concentrate the force of its expansion toward one edge along which the crack approximately occurs.

DESCRIPTION OF THE DRAWINGS

FIG. 1 is side view of a casting made with the mold of FIG. 3.

FIG. 2 is a bottom plan view of the casting shown in FIG. 1.

FIG. 3 is a central, longitudinal cross-section view of a casting mold vented according to the invention.

DESCRIPTION OF THE PREFERRED EMBODIMENT

1. Mold

Figure 4:
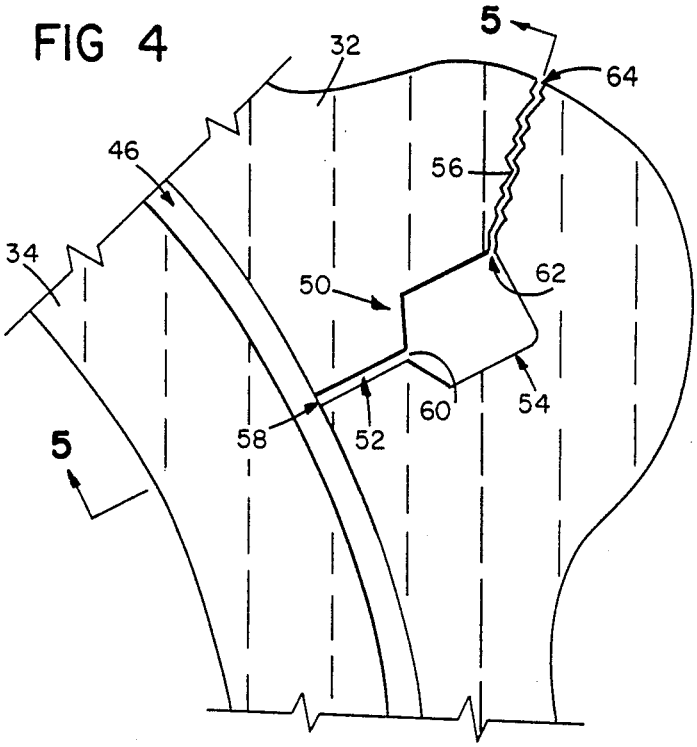
FIG. 4 is an enlarged view of a portion of the right-hand end of the mold of FIG. 3.

The molds illustrated in the drawings have a casting cavity shaped to form the hollow metal golf club head (driver) shown in FIGS. 1 and 2. While the invention is applicable to any shape of the mold cavity, the golf club head shape shown has been selected for illustration because it is an example of a thin-walled casting of large surface area, in the production of which molds according to the invention are utilized with maximum advantages. The casting is discussed first since, with its full shape in mind, cross-section drawings of the mold cavity are more readily understood.

The golf club head shown in FIGS. 1 and 2 has the usual external shape of a driver, except for the protrusion 10 left by the fill gate passage of the mold, this being removed in finishing the casting. The casting is hollow and mainly thin-walled varying from about 0.035 inches (0.80 mm) to about 0.06 inches (1.5 mm) except for the striking face, which is about 0.125 inches (3.18 mm) thick. The stem 12 is open at its free end to receive and be secured to the golf club shaft. FIG. 1 shows the driving face, inclined from the top 14 of the inverted club head to its bottom 16, with the usual, substantially planar, central striking portion 18. Walls 14 and 16 are joined to back wall 19 by toe wall 20, and by the base of stem 12, which forms the heel wall 22. These walls completely enclose the interior of the club head, except for the open end of stem 12 and except for an opening 24 through bottom wall 16 (FIG. 2). Opening 24 provides access to the interior for mold material forming the inside wall of the mold cavity. In the finishing of the casting, the opening 24 is closed by a plate cut to fit it (not shown) resting on three flat tabs 26 molded on the inside surface of bottom wall 16 and projecting beneath the opening at its bottom plane. The plate is then welded about its edges to the sides of opening 24 and finished to complete the club head.

A mold for producing the casting of FIGS. 1 and 2 is shown in central longitudinal section view in FIG. 3 and is designated generally 30. It has a shell type body formed of hard, coherent refractory material, preferably a fully bonded ceramic binder. Its permeability may be as high as other factors will permit, such as of the order of 14 cc nitrogen per square inch (6.5 $cm^2$) of area per minute at a nitrogen pressure of 0.5 p.s.i. However, the venting provided by the present invention, makes mold material permeability much less critical.

The casting cavity in mold 30 will be understood to be the duplicate in shape of the casting shown in FIGS. 1 and 2, formed between the outer wall 32 of the mold, its inner wall 34 and an intermediate connecting portion 36 which defines, with walls 32 and 34, the casting cavity portion corresponding to opening 24 through the bottom of the casting and tabs 26. Portion 38 of the casting cavity forms the inlet gate to the cavity, leaving on the casting vestige 10, which is ultimately removed, and has the heel portion of the cavity 40 at its base. Cavity portion 42 forms the stem 12, cavity portion 44 forms the top 14, cavity portion 46 forms the toe 20 and cavity portion 48 forms the bottom 16, with opening 24 through which intermediate mold wall portion 36 extends. The casting cavity portions shown in FIG. 3 are joined by portions not shown corresponding to the front and back faces. The casting cavity widths conform to those stated above of the finished casting. The walls 32, 34, 36 of the mold are generally about 0.05 inches (1.27 mm) or more in thickness, the thickness varying somewhat with location.

The vent passage which the invention provides in the mold body is designated generally 50 in the drawings. It is located in the outer wall 32 of the mold where it overlies the toe portion 46 of the casting cavity and thus is remote from the inlet portion of the cavity 38, as is desirable for maximum effectiveness. Furthermore, it extends upwardly from a horizontal plane through the inlet, which is normally horizontal during the fill operation later described, thus causing gravity to work against rather than for any flow of casting material into the vent passage. While shown in FIG. 3, the detail of the vent passage is better shown in the enlarged view of FIG. 4 and the cross-section view of FIG. 5, to which reference will now be made.

Figure 5:
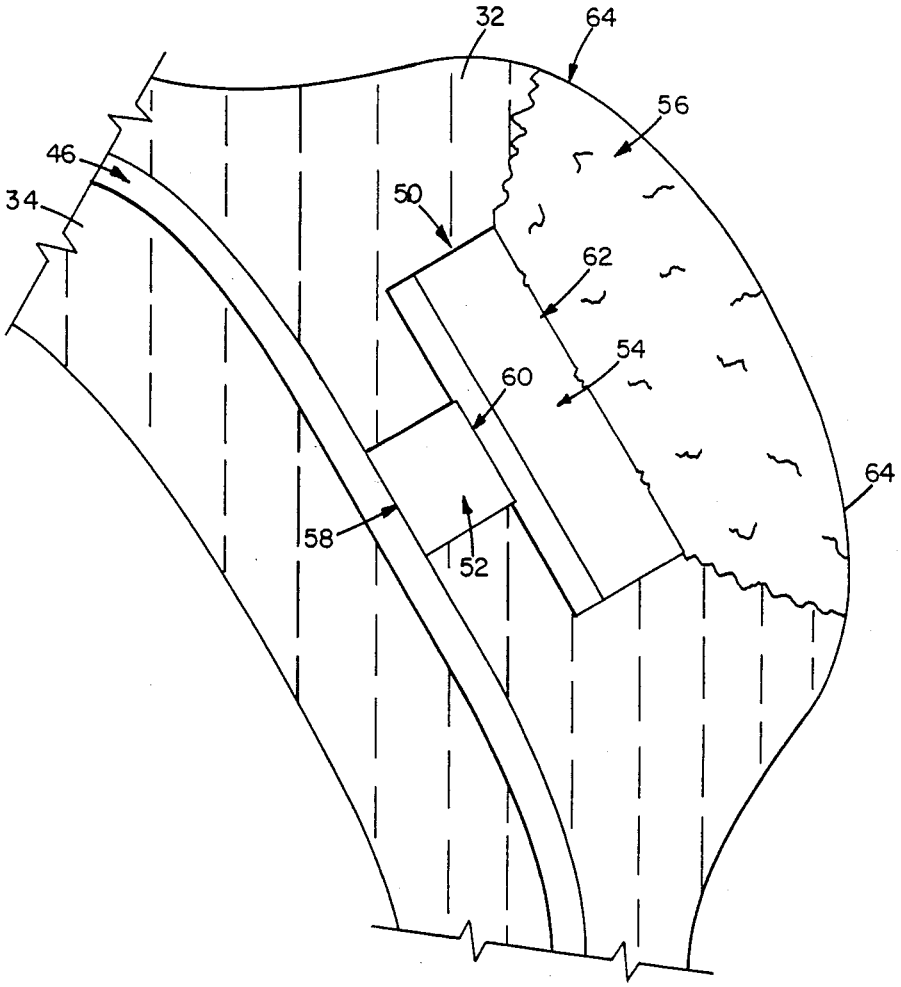
FIG. 5 is a cross-section view taken on line 5—5 of FIG. 4, looking in the direction of the arrows.

As shown in FIGS. 4 and 5, vent passage 50, formed in the mold wall 32, has an inlet portion 52, an intermediate portion 54 and an outlet portion in the form of a crack 56. Portions 52 and 54 were molded about a pattern and therefore are of predetermined regular shape. Portion 52 is of rectangular shape and has one end opening through mold wall 32 into casting cavity portion 46 at 58. The minimum transverse cross-section dimension of opening 58 is sufficiently less than the minimum transverse cross-section dimension of cavity portion 46 (i.e., the dimension toward the opposite wall of the cavity formed by inner wall 34 of the mold body), so that it has a substantially greater resistance to flow therein of casting material than does the cavity. Preferably, this dimension is about 0.02 inches (0.51 mm), as previously stated. As shown in FIG. 5, the other cross-dimension of opening 58 is preferably substantially greater, as shown corresponding to a several times greater length than width of passage portion 52, to provide a correspondingly greater cross-section area of the opening.

The end of vent passage portion 52 opposite opening 58, opens at 60 into intermediate portion 54, the sidewalls of which incline outwardly from opening 60 to the remainder thereof, which is substantially square in the cross-section of FIG. 4 and elongate, rectangular in the cross-section of FIG. 5, extending beyond each end of opening 60. Intermediate portion 54 is thus a considerable enlargement of passage portion 52. Its particular size and shape are in part dictated by the crack-forming function of the pattern from which it is molded, as is particularly described hereinafter in the description of the preferred process by which the mold was made.

The crack portion of the vent passage is formed along the outer, upper long side edge of intermediate portion 54 for its full length, opening into that portion at 62. From opening 62 the crack proceeds outwardly and upwardly, enlarging in length in the plane of FIG. 5 as it proceeds, and opens at 64 through the outer surface of outer wall 32 of the mold. The minimum transverse cross-section of the crack shown in FIG. 4 is less than that of the inlet opening 58 and small enough to prevent any casting material that may leak into vent passage intermediate portion 54 from leaking further out of the mold. Usually it is about 0.015 inches (0.381 mm) or less, adequate, however, to exhaust gas from passage intermediate portion 54 as fast as it is exhausted thereto by inlet portion 52. The added length of the crack due to enlargement 54 as compared with inlet opening 60 insures adequate functioning of the crack.

Figure 6:
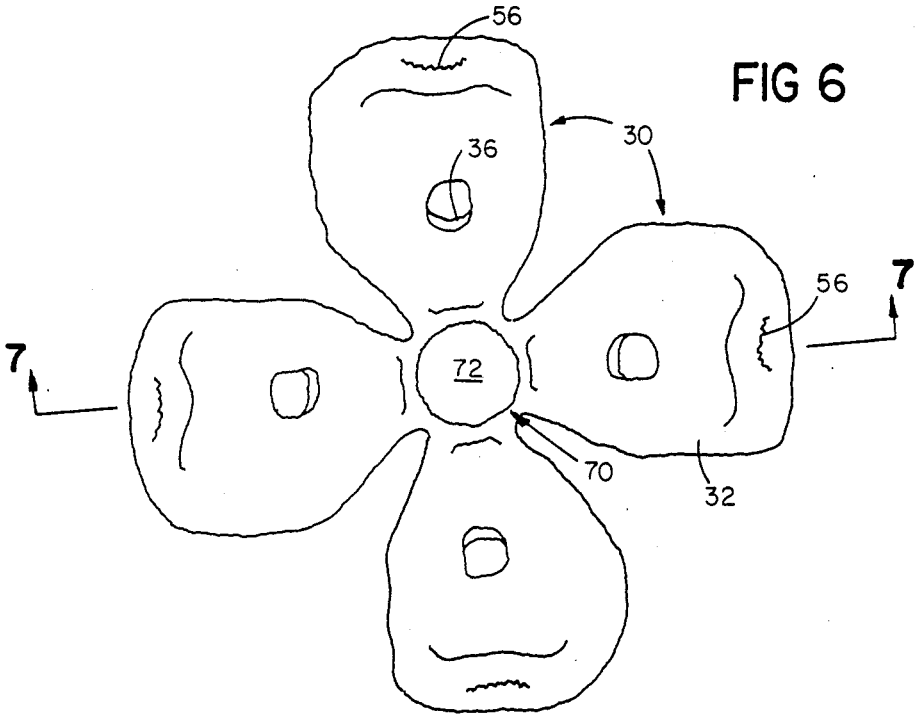
FIG. 6 is a top plan view of an assembly of molds according to FIGS. 3-5 integral with a common riser, shown with completed castings therein.
Figure 7:
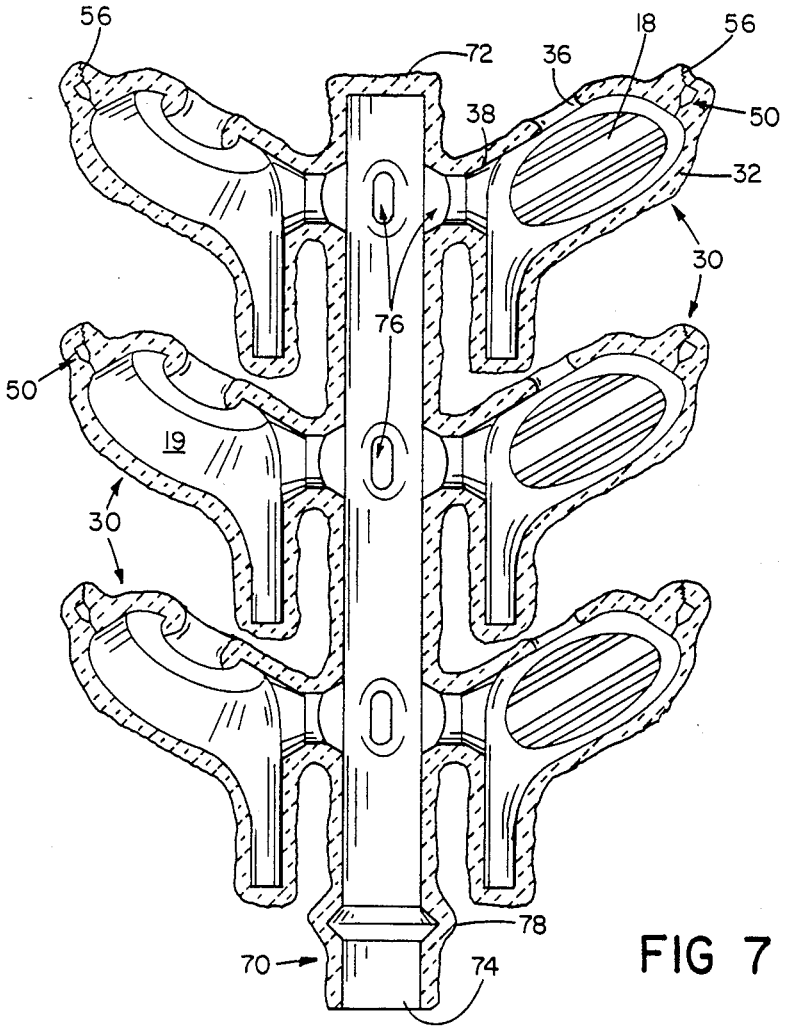
FIG. 7 is an elevation view broken away on line 7—7 of FIG. 6 to expose the interior, looking in the direction of the arrows.

Size permitting, as it does with the casting mold shown, the individual casting molds shown in FIG. 3 are formed in multiple, clustered about a common riser passage, with which their gate portions communicate, and with which they are integrally formed. Such a composite mold of riser and casting cavity molds, made according to the process, hereinafter described, is shown in FIGS. 6 and 7. In these Figures, the individual casting molds 30 are the same as in FIGS. 3–5, shown, however, with the casting cavity filled with a finished casting, before the molds 30 have been broken up and removed from the outside of the casting and from its inside through aperture 24. FIG. 7 shows part of the composite mold broken away along line 7—7 of FIG. 6 to show, at the right, front views, and, at the left, back views, of the castings. The casting molds 30 are in groups or layers of four, with their inlet gate passages 38 communicating with the interior of, and integrally joined to a hollow riser passage, designated generally 70, formed of the same ceramic material and which has a closed top 72, an open bottom inlet 74 for the casting material and individual outlets 76 to the several casting molds, being exposed to their gate portions 38.

In accordance with the process of the aforesaid patents, the composite mold of FIGS. 6 and 7 has been placed in a vacuum chamber with its inlet end protruding and lowered so that its inlet end was immersed in molten metal to be cast. Vacuum in the chamber caused the molten metal to be drawn up into the composite mold, filling the tube and, via gate passages 48 and with the aid of the vent passages 50 of the invention added to mold permeability, completely filling out the casting cavities of the individual casting molds 30. After a momentary preliminary set time for the castings, the vacuum was released, before the molten metal in the riser could set, so that the molten metal ran back into the crucible holding the molten metal supply, leaving the castings as shown. A small outward flange 78 on the wall of the riser 70 near its bottom forms a surface for sealing the mold against the vacuum chamber wall.

Normally, the vent passages are not penetrated by the casting material as indicated in FIG. 7, but if they are, this will only be after the casting cavity has been completely filled, and penetration will stop at passage mid-portion 54. The vestige of any penetration is readily removed in the finishing operation, as is the vestige 10 of the gate portion.

More than one vent passage 50 can be provided per casting mold, but in the instance shown one has been sufficient. It increases the permeability of the mold several times, with improved casting fill out and enables better surface finish. More vent passages may be desirable, particularly with larger molds. Also, where it is desirable to utilize mold-forming material of lower permeability, more than one vent passage may be needed.

2. Method

An advantage of the vent passage structure of the invention is that it can readily be, and is preferably, formed in conjunction with the so-called "lost wax" process of forming the mold about a wax pattern of its shaped casting cavity, which is subsequently melted and drained and vaporized out. The ensuing description details, and FIGS. 8–12 illustrate, how this advantageous and widely used process of making individual casting molds such as mold 30 and composites thereof with a riser, can be conveniently modified to provide the vent passages 50 according to the invention.

Figure 8:
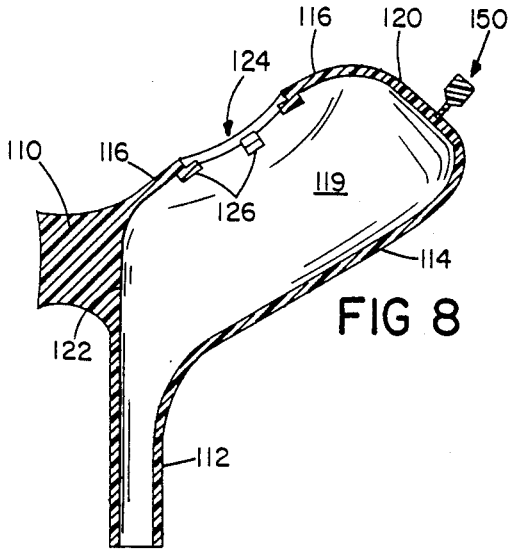
FIG. 8 is a central, longitudinal cross-section view of the wax pattern used in forming molds according to FIG. 3.

FIG. 8 shows a wax pattern for the casting cavity of a mold 30 to be formed by the lost wax process, with a vent-forming pattern at the toe which is not wax. The wax pattern being a duplicate of the casting of FIGS. 1 and 2, (and therefore the solid complement of the casting cavity of molds 30), its various portions are given reference numerals 100 plus the corresponding reference numerals of FIGS. 1 and 2. The wax pattern of FIG. 8 is formed from precision metal mold parts. The mold for the pattern exterior is split longitudinally, as in the plane of the section view of FIG. 8, which are closed together during filling with molten wax of which the pattern is formed through its gate section corresponding to gate vestige 110. The two parts are separated for removal of the hardened wax pattern. The mold for the interior of the wax pattern is formed of several pieces which are assembled together and are of a size such that they can be disassembled and withdrawn through the bottom opening 124 of the hardened pattern. They are attached through that opening to a support which positions the interior mold parts correctly relative to the independently supported exterior mold parts.

The wax pattern for the riser 70 of FIGS. 6 and 7 is molded separately, using a longitudinally split mold. The wax casting patterns of FIG. 8, individually molded as just described, are then assembled to the molded riser pattern by wax-welding their gate portions 110 to the exterior of the riser pattern. The assembled composite of patterns of casting cavities and riser cavity is then alternately exposed to liquid ceramic material and fluidized dry ceramic in well-known manner to form the bodies of the casting molds 30 and integral riser 70 to desired thickness about the patterns.

Figure 9:
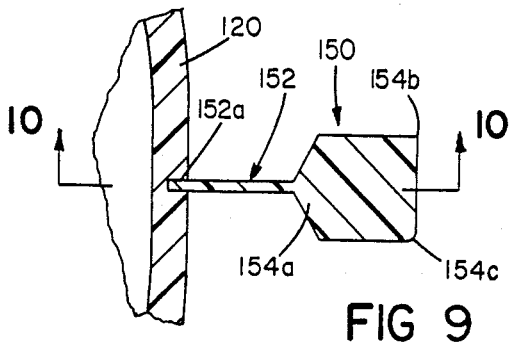
FIG. 9 is an enlargement of part of the outer, right-hand end portion of FIG. 8.
Figure 11:
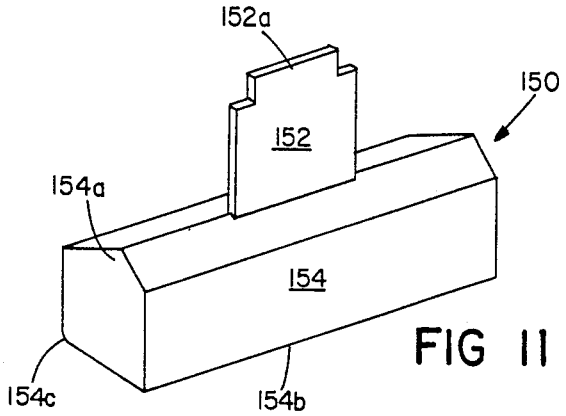
FIG. 11 is a perspective, enlarged view of the vent-forming pattern used.
Figure 10:
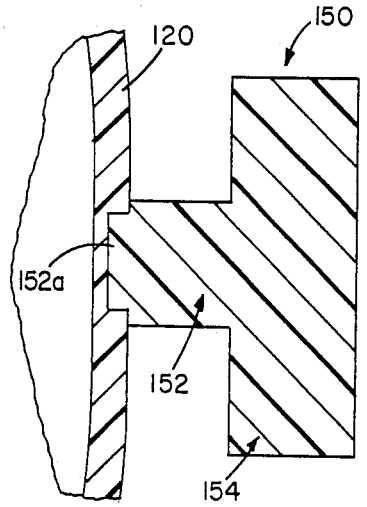
FIG. 10 is a cross-section view taken on line 10—10 of FIG. 9, looking in the direction of the arrows.

The pattern for forming the vent passage designated generally 150 is the complement, with one exception, of the molded inlet portion 52 and intermediate portion 54 of the vent passage 50 of the ultimate casting mold 30 as shown in FIGS. 3–7, and is given corresponding reference numerals plus 100. The exception is that the inlet portion 152 has an extension **152*a* at its inlet end, somewhat shorter than the maximum dimension of that end and also extending less than the minimum dimension of the molding cavity portion of the mold 30 with which it is to be associated. This extension is used to anchor the vent-forming pattern securely in the wax body of the pattern, as it is shown in FIGS. 8–10 and 12. This is preferably accomplished by forming the adjacent portion of the wax pattern about the extension, for which purpose the external mold parts for the wax pattern, described above, are modified to provide when closed a space for holding the vent-forming pattern in its described position relative to the toe portion 120 of the wax pattern, and so that extension 152***a* will extend into the wax of the toe portion of the pattern when molded, as shown in FIGS. 9 and 10. The hardened wax pattern removed from its mold has the vent-forming pattern attached as shown in FIG. 8, and the ceramic body of the mold 30 is formed about it as well as about the wax casting pattern when the composite wax casting and riser portions are alternately exposed to liquid ceramic and dry ceramic, as previously described herein.

After the ceramic coating is formed about the composite wax and vent-forming patterns, the composite is, as usual, placed in an autoclave, arranged so that the open inlet end of the riser is down. In the autoclave, the composite is heated above the melting point of the wax patterns for about 15 minutes. The melting point of the wax used is relatively low, such as about 160° F., while the autoclave temperature is higher, generally about 340° F. Near the end of the autoclave treatment the wax is fully melted before it expands sufficiently to distort the casting cavity or damage the mold. Most of the melted wax flows downward by gravity from the composite, partially hardened mold.

Figure 12:
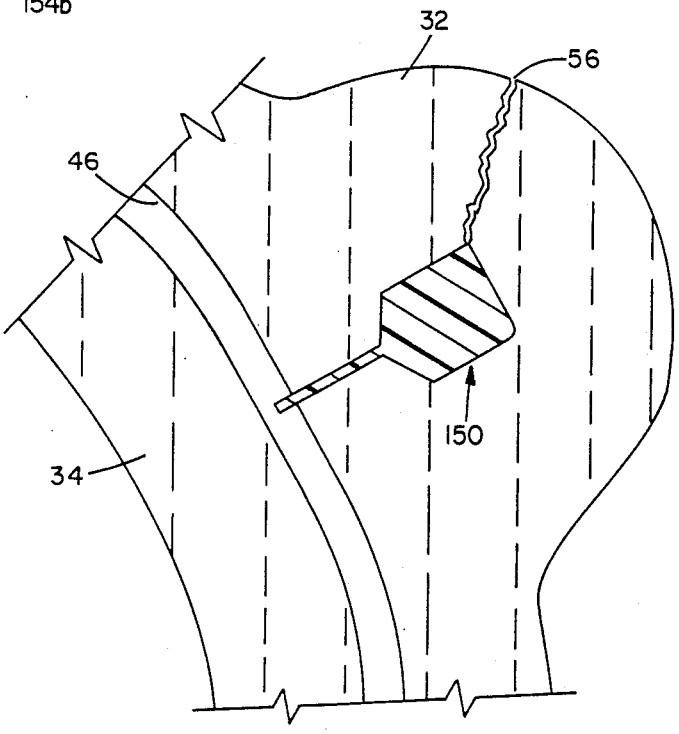
FIG. 12 is a view similar to FIG. 4 after the mold has been formed about the wax pattern and the melted wax pattern has been removed.

However, as described previously, the vent-forming patterns are made of higher melting point material than the wax, such as nylon or polystyrene. They continue to expand after the wax melts, up to a mold temperature of at least 225° F., before they soften or melt. Expansion of the vent-forming patterns causes the casting molds 30 to crack, forming the crack 56 extending through the mold body from an outwardly directed long edge of mid-section 154 of the vent-forming pattern. FIG. 12 is a view similar to FIG. 4 showing the cracked portion of the mold as it comes out of the autoclave, with the vent-forming pattern still in place in the outer wall 32 of mold 30 now formed about it, though not yet in the final hardened state. After the autoclave treatment, the composite of casting molds 30 and riser 70 is placed in an oven kept at substantially higher temperature, about 2000° F. with the molds described, for two hours or more for final curing and to vaporize out the vent-forming patterns 150, the vapors escaping through cracks 56. In like manner, the remaining residue of wax pattern is vaporized and escapes.

In the design of the vent-forming pattern, certain factors are significant in producing controlled cracking of the mold. One of these is, of course, the material from which the pattern is made. Nylon and polyamide which do not soften materially at temperatures below 225° F. have been found to be about equally suitable. Other plastics or materials having like softening and expansion characteristics could be used, provided they also have sufficiently similar tensile strength to maintain their shape and location under the stresses placed upon them during the formation of the mold shell about them.

Other factors are dimensions and shape. It is desirable that the minimum transverse cross-section of the inlet portion 152 be about 0.02 inches (5.1 mm);—less would be of questionable tensile strength and lower permeability, more would be more prone to permit too much leakage. The other transverse cross-dimension is desirably longer for both permeability and strength. The shape and size of the enlarged portion 154 were selected in part for crack controlling function. The V-shaped or trianglar portion 154*a* shown in FIGS. 9 and 11 tends to direct expansion force away from it toward opposite long edges 154*b* and 154*c*, and to direct expansion force toward it along inlet portion 152 more than against the mold body. Edge 154*c* is rounded, however, so that the transverse expansion force is most concentrated along sharp edge 154*b*, along which the crack is to occur and cracking along edge 154*c* is inhibited. The formation of two generally parallel cracks is undesirable because of potential breaking out of the piece between them. The longest dimension of the vent-forming pattern, which includes edges 154*b* and 154*c*, controls the length of the crack and also the extent of the longitudinal expansion force. A length of 0.75 inch (19.1 mm) for this longest dimension has proved to be satisfactory for the molds illustrated herein and others. Excessive length of this dimension could produce excessive longitudinal expansion force, either causing crack 56 at the desired location to be too large or to cause additional undesired cracking. The transverse cross-section of FIG. 9, less the portion 154*a*, is essentially square, with sides 0.20 inches (5.1 mm) long. Together with cross-section part 154*a*, these square side dimensions control the extent of the cross-section expansion and, in this embodiment, should be less than 0.30 inches (7.6 mm), preferably as stated.

It will be understood that while the particular vent forming pattern illustrated and described has been established as effective and reliable for the practice of the invention with shell molds as shown, it is believed that patterns of other shapes and dimensions can also be used, particularly where there may be variations in the material of the mold or of the vent pattern from those given herein.

I claim:

1. A vented casting mold having a body of hard coherent refractory material containing a cavity for casting a desired shape, and at least one vent passage suitable for venting gas from the interior of a portion of said cavity through the exterior of said mold body, said passage comprising:

a portion of a predetermined regular shape extending only part way through the cavity wall and defining at one end an inlet portion opening into a portion of said cavity, said inlet portion having one of its transverse cross-section dimensions adjacent said opening sufficiently short that said inlet portion has a substantially greater resistance than said cavity portion to penetration therein of casting material, and an outlet portion formed by an irregular crack in said mold body extending from an inner end exposed to said inlet portion through the outer surface of said mold body, said crack having one of its transverse cross-section dimensions sufficiently short to prevent leakage therethrough of casting material able to penetrate said inlet portion.

2. A casting mold according to claim 1 wherein said one of the transverse cross-section dimensions of said crack is shorter than said one of the transverse cross-section dimensions of said inlet portion.

3. A casting mold according to claim 2 wherein said one of the transverse cross-section dimensions of said inlet portion is about 0.02 inches.

4. A casting mold according to claim 3 wherein said one of the transverse cross-section dimensions of said crack is shorter than 0.015 inches.

5. A casting mold according to any of claims 1 to 4 wherein the other transverse cross-section dimension of said crack is longer than, and substantially parallel to, the other transverse cross-section dimension of said inlet portion.

6. A casting mold according to claim 5 wherein the end of said passage portion of predetermined, regular shape remote from said cavity has enlarged transverse cross-section dimensions relative to said inlet portion.

7. A casting mold according to claim 5 wherein the refractory material of said body is formed of a solidified mixture of liquid and dry ceramic material.

8. A method of making a vented casting mold from a partially bonded, refractory material which is heat-hardenable to a hard, coherent state, comprising the steps of:

forming the mold body from said material in said partially bonded state containing a casting cavity and incorporating in a wall of said cavity at least one vent pattern having a shape and located to mold in said body a vent passage portion of predetermined, regular shape extending only part way through said wall and having an inlet end with an opening into said cavity;

heating the mold body to a temperature below the melting point temperature of said pattern for a time sufficient so that heat-expansion of said pattern causes the mold body to crack, forming a crack extending from said vent passage portion through the exterior of said mold body to complete said vent passage, and having one of its transverse cross-section dimensions too short to permit leakage of material being cast in said cavity therethrough; and further heating the mold at a sufficiently higher temperature and for a time sufficient to cause said pattern to volatilize and escape from said mold body and to completely harden the mold body.

9. A method according to claim 8 wherein said casting cavity is formed by a casting pattern contained therein, said vent pattern is attached to said casting pattern, and said casting pattern has a lower melting point temperature than said vent pattern such that it melts to a removable molten state while said mold body is heated below the melting point temperature of said vent pattern.

10. A method according to claim 9 wherein the material forming said vent pattern has substantially higher tensile strength than the material forming said casting pattern and at least substantially equal to that of nylon.

11. A method according to any of claims 8 to 10 wherein said vent pattern is shaped to concentrate the forces of its expansion most highly toward an edge portion thereof along which said crack approximately occurs.

12. A method according to claim 11 wherein said edge portion is comprised in a portion of said vent pattern which is enlarged relative to the inlet end-forming portion of said pattern.

* * * * *